US008011055B2

(12) United States Patent
Lesley

(10) Patent No.: US 8,011,055 B2
(45) Date of Patent: Sep. 6, 2011

(54) CLEANING IMPLEMENT

(75) Inventor: Paul M. Lesley, Blue Island, IL (US)

(73) Assignee: Carl Freudenberg KG, Weinheim (DE)

( * ) Notice: Subject to any disclaimer, the term of this patent is extended or adjusted under 35 U.S.C. 154(b) by 1037 days.

(21) Appl. No.: 11/754,717

(22) Filed: May 29, 2007

(65) Prior Publication Data

US 2008/0010768 A1 Jan. 17, 2008

Related U.S. Application Data

(60) Provisional application No. 60/810,405, filed on Jun. 1, 2006, provisional application No. 60/905,940, filed on Mar. 9, 2007.

(51) Int. Cl.
*A47L 13/14* (2006.01)
*A47L 13/20* (2006.01)
*A47L 13/50* (2006.01)

(52) U.S. Cl. ..... 15/119.1; 15/120.1; 15/120.2

(58) Field of Classification Search ..... 15/120.1, 15/120.2, 116.1, 119.1
See application file for complete search history.

(56) References Cited

U.S. PATENT DOCUMENTS

| | | | |
|---|---|---|---|
| 435,976 | A | 9/1890 | Mullen |
| 1,273,768 | A | 7/1918 | Gillam |
| 3,462,788 | A | 8/1969 | Abbott |
| D228,250 | S | 8/1973 | Young et al. |
| 3,946,457 | A | 3/1976 | Robinson |
| 4,130,910 | A | 12/1978 | Raven |
| 4,178,650 | A | 12/1979 | Aasland |
| 4,464,807 | A | 8/1984 | Weiss |
| 4,479,278 | A | 10/1984 | Heinonen |
| 4,809,387 | A | 3/1989 | Nakamura et al. |
| D311,077 | S | 10/1990 | Nakamura et al. |
| 5,060,338 | A | 10/1991 | Yates et al. |
| 5,509,163 | A | 4/1996 | Morad |
| 5,566,417 | A | 10/1996 | Hsieh |
| 5,577,290 | A | 11/1996 | Monahan |

(Continued)

FOREIGN PATENT DOCUMENTS

| | | | |
|---|---|---|---|
| DE | 3607121 | A1 | 9/1987 |

(Continued)

OTHER PUBLICATIONS

Patent Abstracts of Japan, JP 07-255658, Sep. 10, 1995.

*Primary Examiner* — Monica S Carter
*Assistant Examiner* — Stephanie Newton
(74) *Attorney, Agent, or Firm* — Leydig, Voit & Mayer, Ltd.

(57) ABSTRACT

A cleaning implement that includes a shaft, a mop disposed on one end of the shaft, a wringer, and a fixed grip. The wringer includes a wringing sleeve and a wringer handle. The wringer is movable over a range of travel between a mopping position and a range of wringing positions, in which wringing positions the wringing sleeve covers and compresses at least a portion of the mop to thereby expel liquid from the mop. The wringer is rotatable relative to the shaft through at least a portion of the axial range of travel. The wringer further comprises at least one volute wherein the volute defines a semi-enclosed area inside the wringer, the semi-enclosed area configured to receive a portion of the mop through a gap defined in the volute. The volute includes a first fin and a second fin that define the gap therebetween.

24 Claims, 21 Drawing Sheets

U.S. PATENT DOCUMENTS

| | | | | |
|---|---|---|---|---|
| 5,642,551 | A | 7/1997 | Cann et al. | |
| D384,458 | S | 9/1997 | Schroeck et al. | |
| 5,675,857 | A | 10/1997 | Hirse | |
| 5,675,858 | A | 10/1997 | von Meyer | |
| D387,526 | S | 12/1997 | Berti et al. | |
| D387,527 | S | 12/1997 | Specht | |
| 5,722,105 | A | 3/1998 | Thomasson | |
| 5,724,694 | A | 3/1998 | Lewis | |
| 5,819,356 | A | 10/1998 | Cann | |
| 5,850,658 | A | 12/1998 | Specht | |
| 5,875,509 | A | 3/1999 | Facca | |
| 5,890,253 | A | 4/1999 | Morad | |
| 5,894,625 | A | 4/1999 | Vosbikian | |
| 5,907,883 | A | 6/1999 | Thomasson | |
| 5,913,347 | A | 6/1999 | Wilen | |
| 5,976,266 | A | 11/1999 | Anderson et al. | |
| 5,996,161 | A | 12/1999 | Facca | |
| 6,006,392 | A | 12/1999 | Seculov et al. | |
| 6,058,549 | A | 5/2000 | Milward-Bason | |
| 6,076,220 | A | 6/2000 | Petner | |
| 6,085,378 | A | 7/2000 | Petner | |
| 6,088,867 | A | 7/2000 | Stefani et al. | |
| 6,108,848 | A | 8/2000 | Monahan | |
| 6,112,358 | A | 9/2000 | Specht | |
| 6,115,869 | A | 9/2000 | Libman | |
| 6,125,494 | A | 10/2000 | Morad | |
| 6,212,727 | B1 | 4/2001 | Bendor | |
| 6,212,728 | B1 | 4/2001 | Facca et al. | |
| 6,233,775 | B1 | 5/2001 | Franke | |
| 6,240,589 | B1 | 6/2001 | Specht | |
| 6,378,156 | B2 | 4/2002 | Specht | |
| 6,427,280 | B1 | 8/2002 | Specht | |
| 6,477,731 | B2 * | 11/2002 | Monahan | 15/120.1 |
| 6,523,211 | B2 | 2/2003 | Wang | |
| 6,526,617 | B1 | 3/2003 | Dingert | |
| D474,869 | S | 5/2003 | Libman | |
| 6,615,437 | B1 | 9/2003 | Chow | |
| 6,675,427 | B1 | 1/2004 | Chiapelli et al. | |
| 6,732,396 | B2 | 5/2004 | Laux et al. | |
| 6,745,429 | B2 | 6/2004 | Ng | |
| 6,920,664 | B2 | 7/2005 | Libman et al. | |
| D522,702 | S | 6/2006 | Libman et al. | |
| D532,569 | S | 11/2006 | Libman et al. | |
| D575,468 | S * | 8/2008 | Berti et al. | D32/51 |
| 2001/0013150 | A1 | 8/2001 | Specht | |
| 2002/0092105 | A1 * | 7/2002 | Laux et al. | 15/120.1 |
| 2002/0108197 | A1 * | 8/2002 | Specht | 15/120.1 |
| 2002/0129457 | A1 | 9/2002 | Wang | |
| 2002/0133892 | A1 | 9/2002 | Monahan | |
| 2003/0000036 | A1 | 1/2003 | Fan | |
| 2003/0079307 | A1 | 5/2003 | Ng | |
| 2003/0084530 | A1 | 5/2003 | Specht | |
| 2003/0208867 | A1 | 11/2003 | Laux et al. | |
| 2003/0213079 | A1 | 11/2003 | Libman et al. | |
| 2003/0226227 | A1 | 12/2003 | Rios et al. | |
| 2004/0006836 | A1 | 1/2004 | Dingert | |
| 2004/0128783 | A1 | 7/2004 | Lesley et al. | |
| 2005/0022327 | A1 | 2/2005 | Cavalheiro | |
| 2006/0016031 | A1 | 1/2006 | Llanes | |
| 2006/0016032 | A1 * | 1/2006 | Libman et al. | 15/120.1 |
| 2006/0021171 | A1 | 2/2006 | Niccolai | |
| 2006/0026785 | A1 | 2/2006 | Sampalo | |

FOREIGN PATENT DOCUMENTS

| | | | |
|---|---|---|---|
| DE | 4019480 | C1 | 2/1992 |
| DE | 29520612 | U1 | 3/1996 |
| DE | 19524440 | C1 | 8/1996 |
| DE | 10207384 | A1 | 11/2003 |
| EP | 162815 | A1 | 11/1985 |
| EP | 1030586 | B1 | 8/2000 |
| ES | 2117588 | | 8/1998 |
| FR | 2622785 | | 5/1989 |
| GB | 1300709 | | 12/1972 |
| GB | 1548060 | | 7/1979 |
| GB | 1577370 | | 10/1980 |
| GB | 1586313 | | 3/1981 |
| GB | 2285391 | A | 7/1995 |
| WO | WO 91/19450 | | 12/1991 |
| WO | WO 95/07046 | | 3/1995 |
| WO | WO 96/20632 | | 7/1996 |
| WO | WO 97/24973 | | 7/1997 |
| WO | WO 99/23930 | | 5/1999 |
| WO | WO 2004/021851 | A1 | 3/2004 |
| WO | WO 2004/023966 | A1 | 3/2004 |
| WO | WO 2005/089619 | A1 | 9/2005 |
| WO | WO 2006/025814 | | 3/2006 |

* cited by examiner

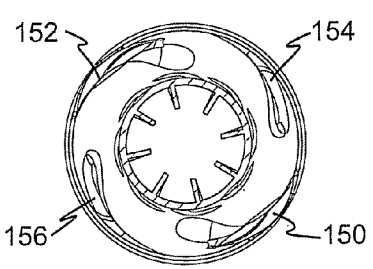
SECTION B-B
FIG. 9
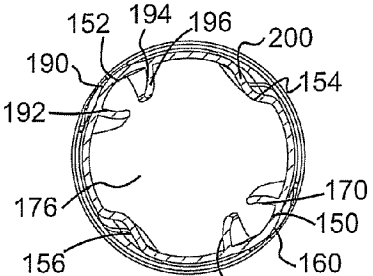
SECTION D-D
FIG. 11
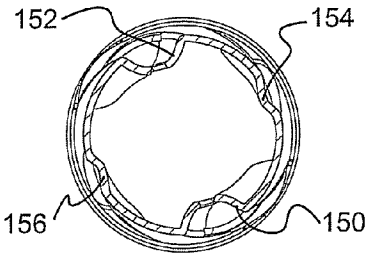
SECTION C-C
FIG. 10
FIG. 8
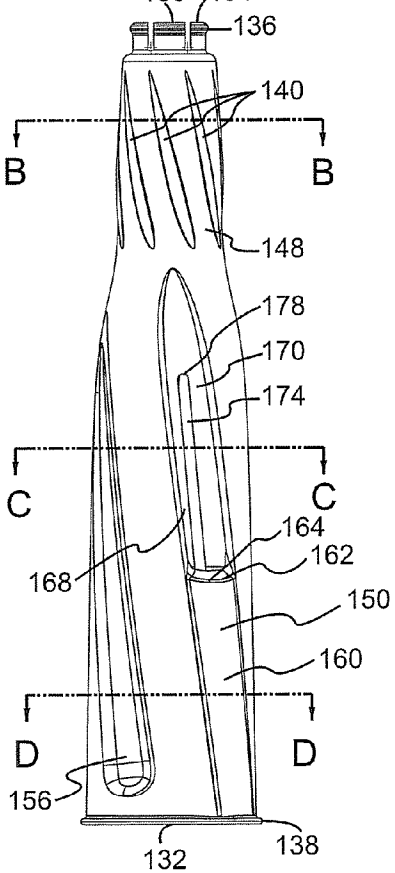

CLEANING IMPLEMENT

CROSS-REFERENCE TO RELATED APPLICATIONS

This patent application claims the benefit of U.S. Provisional Patent Application No. 60/810,405, filed Jun. 1, 2006, and U.S. Provisional Application No. 60/905,940, filed Mar. 9, 2007, which are incorporated by reference.

FIELD OF THE INVENTION

The present invention relates generally to cleaning implements, and more particularly to a cleaning implement with a wringer.

BACKGROUND OF THE INVENTION

A wide variety of cleaning implements are known in the art, and the prior art has provided numerous sweepers, brooms, mops, and the like. In recent years, one trend in the cleaning implement industry has been towards "self-wringing" cleaning implements or mops, the term "self-wringing" signifying that water or cleaning fluids may be wrung from the cleaning implement without the aid of a separate wringer bucket or other wringing device. One such type of "self wringing" cleaning element is the sleeve-type mop. A principal drawback with many known sleeve-type mops is that it is difficult to expel liquid from the mop during the wringing operation. Another drawback is that such mops can be difficult to operate. The present invention is addressed towards overcoming these drawbacks.

BRIEF SUMMARY OF THE INVENTION

The invention provides a cleaning implement that includes a shaft, a mop that comprises a plurality of liquid absorbent members, such as strings or strips, disposed at one end of the shaft, and a wringing sleeve. The wringing sleeve is moveable axially with respect to the shaft and is rotatable relative thereto.

According to one aspect of an embodiment of the invention, the wringing sleeve forms a part of a wringer that generally comprises the wringing sleeve and a wringer handle that is connected to the sleeve. The wringing sleeve is movable over a range of travel between a mopping position and a range of wringing positions, in which wringing positions the wringing sleeve covers and compresses at least a portion of the mop to thereby expel liquid from the mop. The wringer is rotatable relative to the shaft through at least a portion of the axial range of travel.

According to another aspect of the invention, the cleaning implement includes a fixed grip. The fixed grip may be immovably disposed on the shaft above the wringer. The fixed grip may define the upper most point of axial travel along the shaft of the wringer. The operator may simultaneously grip the cleaning implement at both the fixed grip and at the wringer handle in order to move the wringer axially or rotatably relative to the fixed grip and the shaft.

According to another aspect of the invention, the wringing sleeve comprises a major volute, which includes a generally helicoid surface. The volute assists the sleeve in twisting the mop strings or strips about the shaft to thereby assist in expelling liquid. The volute also includes two opposing fins that run at least a portion of the length of the volute and define a gap therebetween along at least a portion of the length of the fins. When the sleeve is lowered over the mop, at least one strip or string of the mop may be trapped between the fins of the sleeve. The grabbing of the mop strips or strings by the major volute helps ensure that as the sleeve is rotated relative to the shaft, the twisting of the mop is increased due to reduced slippage between the sleeve and the mop.

According to another aspect of the invention, the wringing sleeve may also comprise a minor volute, which includes a generally helicoid surface. As the wringing sleeve is lowered over the mop, the helical nature of the volutes and their engagement with the mop, directs the sleeve to gradually rotate relative to the shaft. The rotating of the sleeve results in the twisting of the mop, with which it is engaged. This rotating and twisting continues until the sleeve reaches the low position on the shaft, all the while wringing liquid from the mop. At this point in the wringing operation, the operator may further rotate the sleeve relative to the shaft. This final wringing force on the mop expels even further liquid from the mop.

BRIEF DESCRIPTION OF THE SEVERAL VIEWS OF THE DRAWING(S)

FIG. 8 is the same view as FIG. 6, except the wringing sleeve has been rotated 90 degrees.

FIG. 9 is a cross-sectional view along line B-B of FIG. 8.

FIG. 10 is a cross-sectional view along line C-C of FIG. 8.

FIG. 11 is a cross-sectional view along line D-D of FIG. 8.

DETAILED DESCRIPTION OF THE INVENTION

Figure 1:
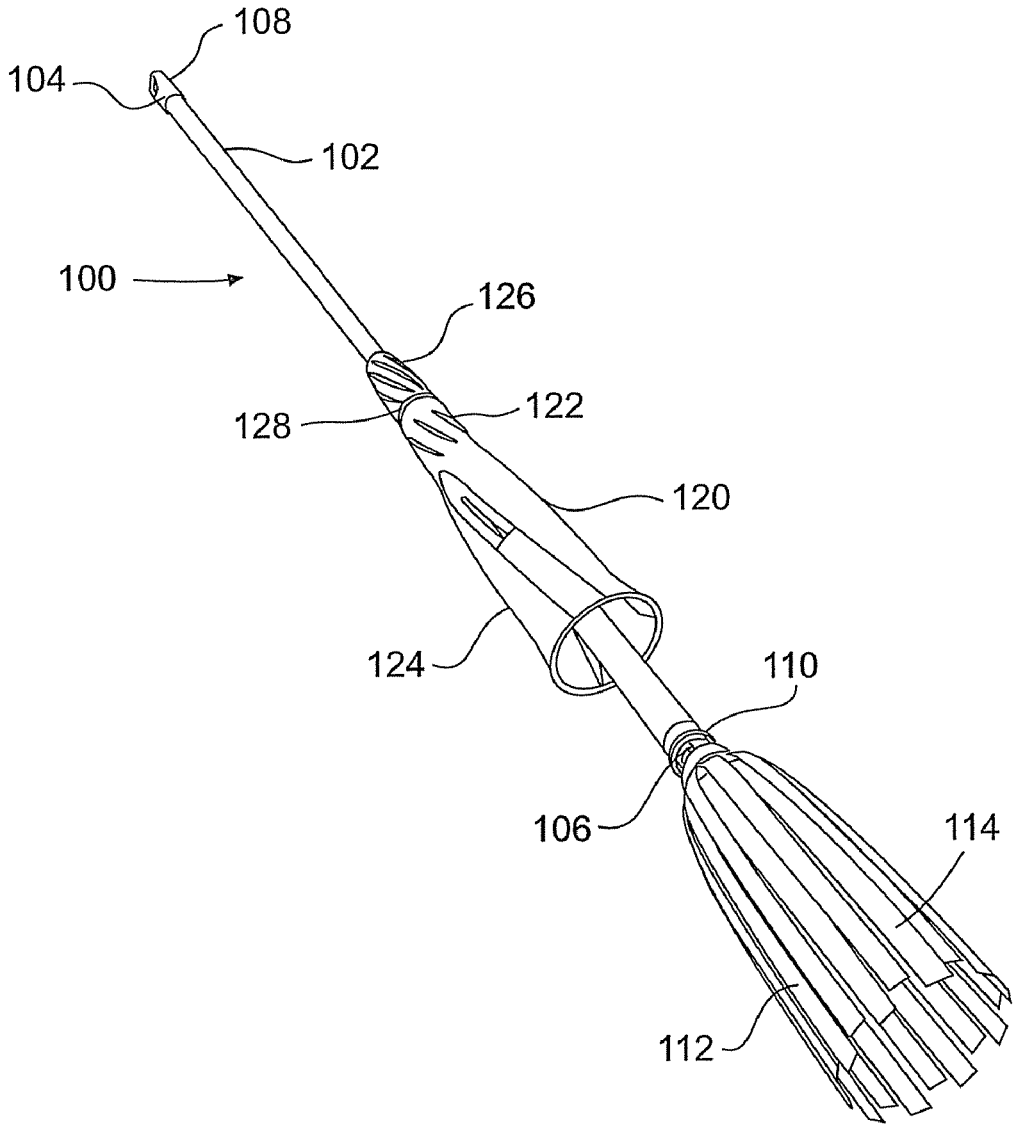
FIG. 1 is a perspective view of one embodiment of the cleaning implement.

Now referring to the drawings, wherein like reference numbers refer to like features, there is illustrated in FIG. 1 an exemplary cleaning implement 100 according to the invention. The cleaning implement 100 comprises a shaft 102 having an operator end 104 and a mopping end 106. A hanger cap 108 is disposed at the operator end of the shaft 102, and a mop assembly 110 that includes a mop 112 is disposed at the mopping end 106. The mop 112 may be made of any suitable liquid absorbent material such as fabric strips, strings, or the like. The mop may be composed of composite fabric strips 114.

Figure 2:
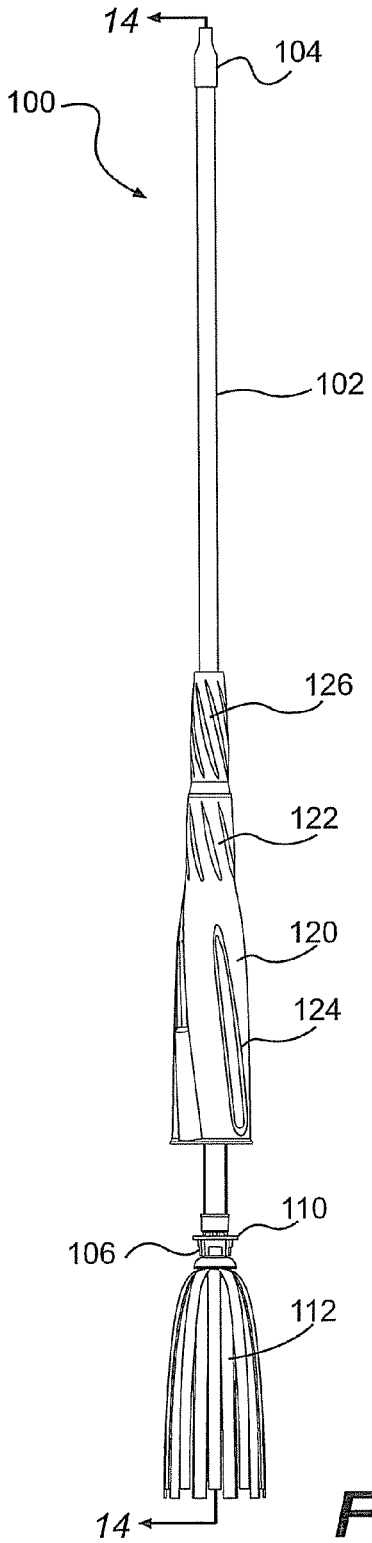
FIG. 2 is a side elevational view of the cleaning implement of FIG. 1.
Figure 3:
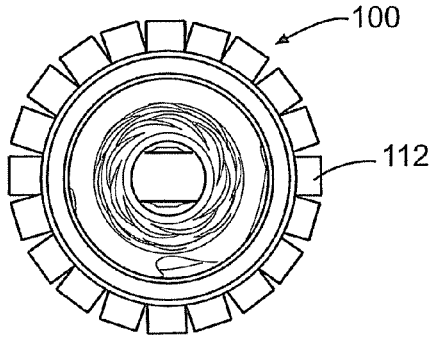
FIG. 3 is a top plan view of the cleaning implement of FIG. 1.
Figure 4:
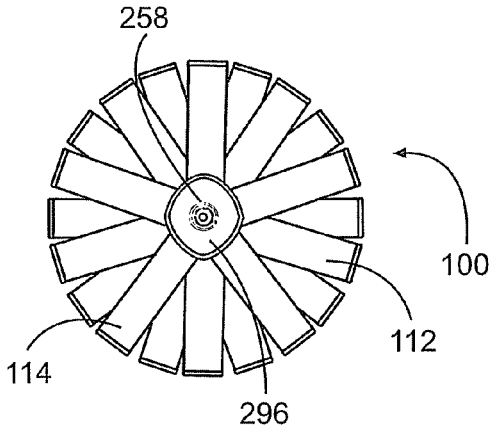
FIG. 4 is a bottom plan view of the cleaning implement of FIG. 1.
Figure 5:
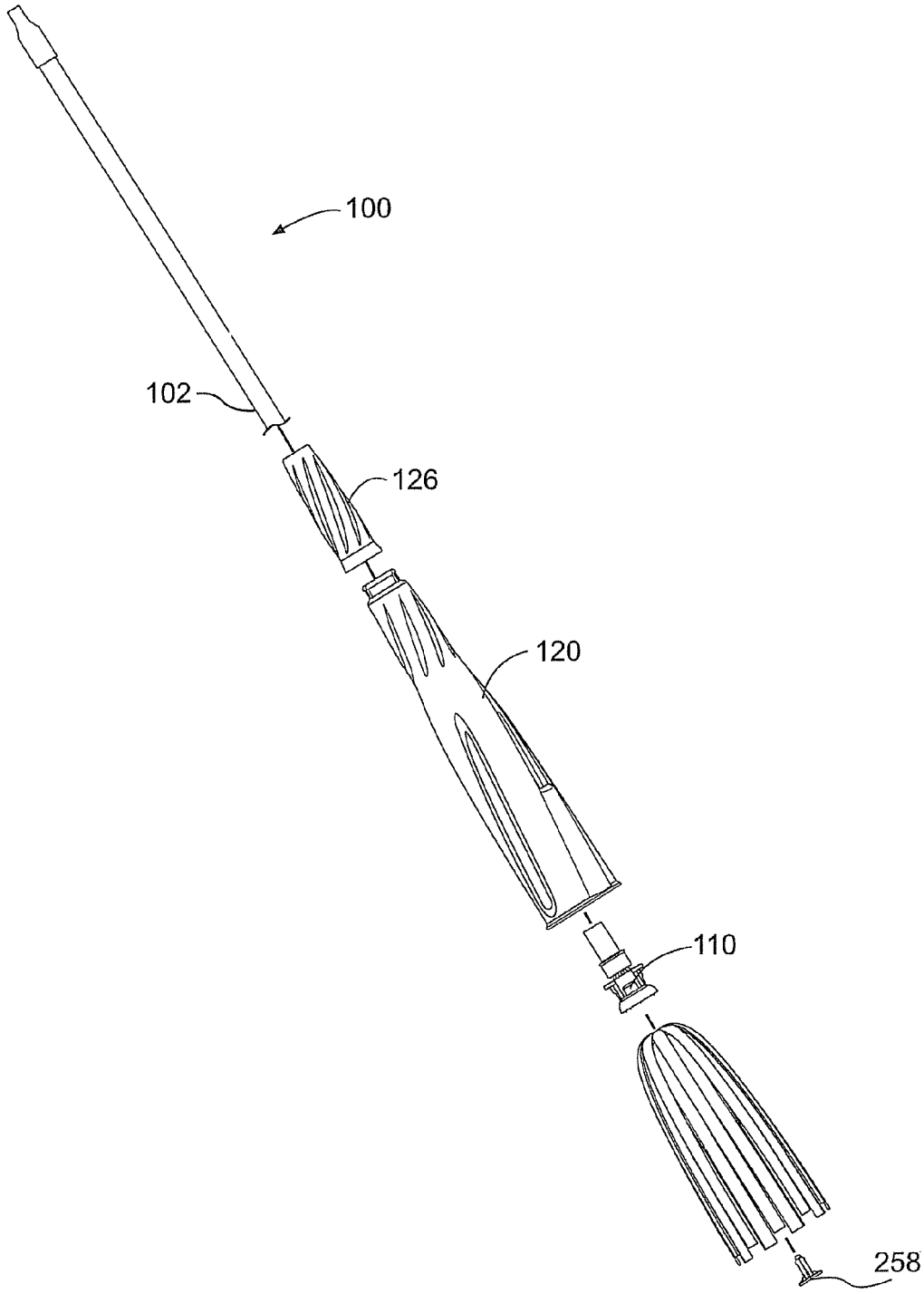
FIG. 5 is a side exploded view of the cleaning implement of FIG. 1.

Referring to FIGS. 1 and 2, the cleaning implement 100 further includes a wringing assembly or wringer 120, the wringer 120 including a wringer handle 122 and a wringing sleeve 124, the handle 122 being disposed relatively proximal the operator end 104 of the shaft 102. The wringer 120 is axially moveable with respect to the shaft 102 over a range of travel between a fully retracted position, as shown in FIGS. 1 and 2, and a range of wringing positions, in which wringing positions the wringing sleeve 124 covers and compresses at least a portion of the mop 112 to thereby expel liquid from the mop 112. The wringer 120 is rotatable relative to the shaft 102 through at least a portion of the axial range of travel of the wringer 120.

Referring to FIG. 1, the cleaning implement 100 includes a fixed grip 126. The fixed grip 126 may be immovably disposed on the shaft 102 above the wringer 120. The fixed grip 126 may define the upper most point 128 of axial travel along the shaft 102 of the wringer 120. The operator may simultaneously grip the cleaning implement 100 at both the fixed grip 126 and at the wringer handle 122 in order to move the wringer 120 axially or rotatably relative to the fixed grip 126 and the shaft 102.

Figure 7:
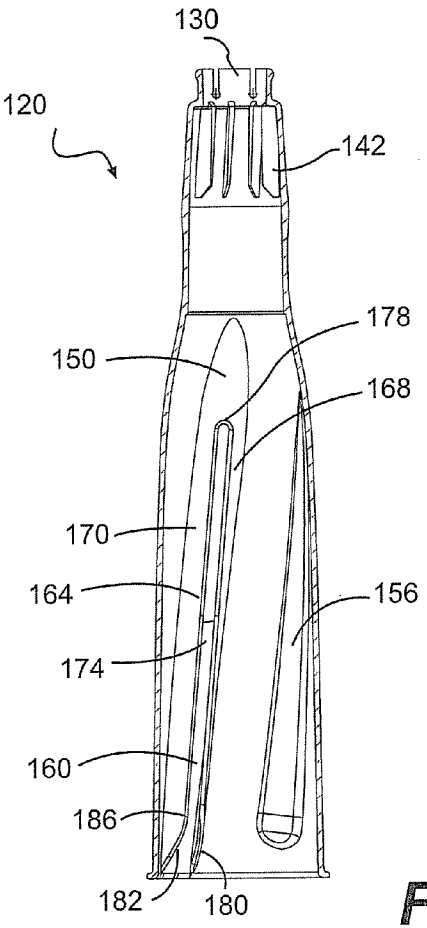
FIG. 7 is a cross-sectional view along line 7-7 of FIG. 6.
Figure 6:
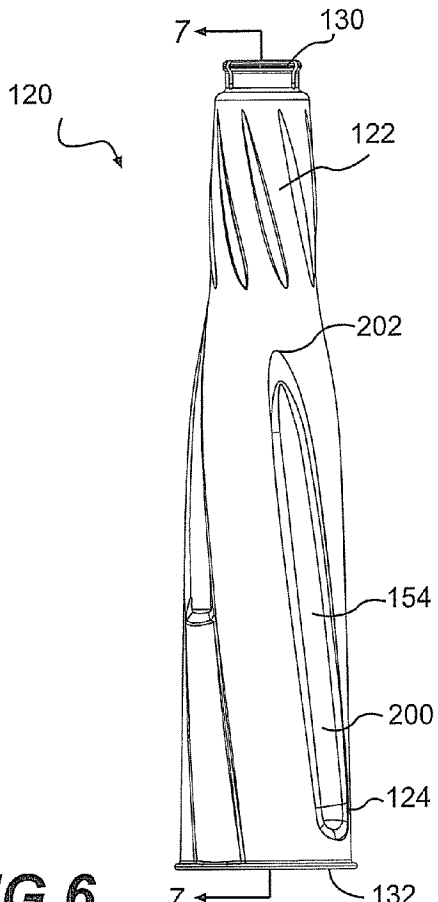
FIG. 6 is side elevational view of the wringing sleeve of the cleaning implement of FIG. 1
Figure 14:
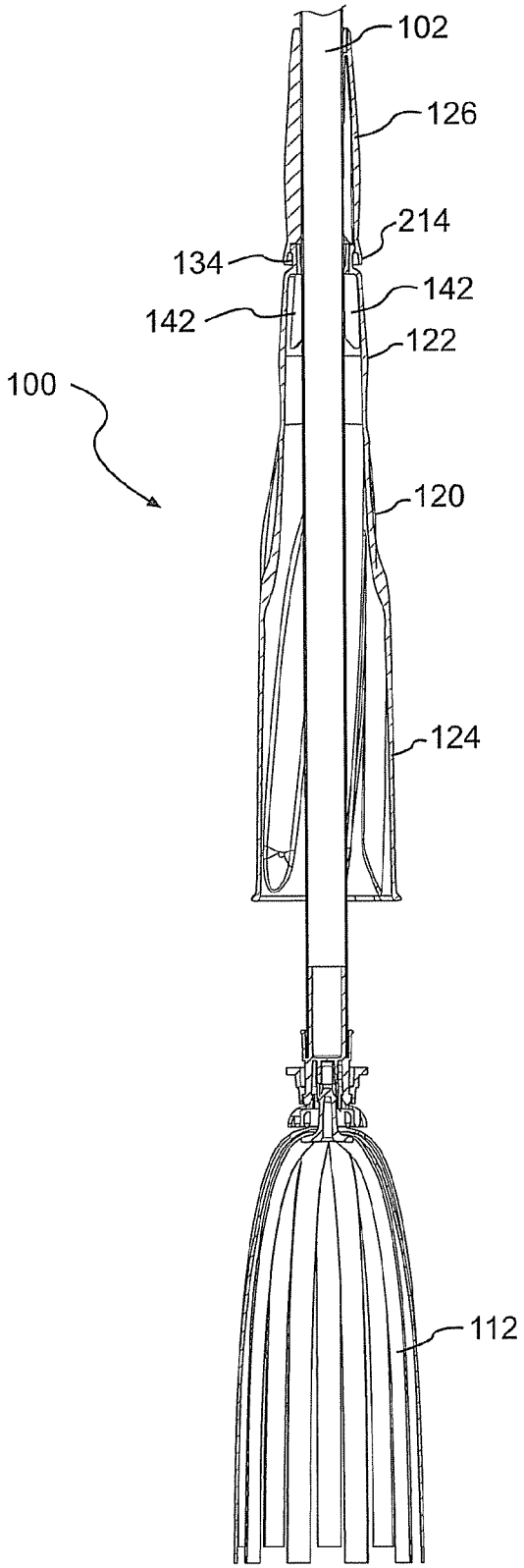
FIG. 14 is a cross-sectional view along line 14-14 of FIG. 2 wherein the wringer is in the mopping position.

Referring to FIGS. 6 and 8, the wringer 120 is shown in more detail. Referring to FIG. 8, the wringer 120 is generally tubular with an upper opening 130, relatively proximate the operator end, and a lower opening 132, relatively proximate the mopping end. The upper opening 130 may be defined by a male piece 134 including a lip 136 while the lower opening 130 may be defined by a rim 138. The wringer handle 122 and the wringing sleeve 124 may be part of the same continuous piece, wherein the wringer handle 122 is located above the wringing sleeve 124. The wringer 120 may generally taper from the wider lower opening 132 to the narrower upper opening 130 with the tapering more drastic at the transition 128 between the sleeve 124 and the handle 122. The handle 122 may include a plurality of helical canals 140 that traverse the handle 122 longitudinally. The helical canals 140 create a non-uniform surface 148 on the handle 122, which aid an operator in better gripping the handle 122. Referring to FIG. 7, the wringer 120 includes a plurality of internal ribs 142 disposed proximate the upper opening 130. Referring to FIG. 14, the internal ribs 142 may engage the shaft 102 and may help stabilize the wringer 120 as it moves up and down the shaft 102.

Referring to FIGS. 8 and 11, the wringing sleeve 124 may include two major volutes 150, 152 and two minor volutes 154, 156, arranged in an alternating pattern. The volutes 150, 152, 154, 156 may be arranged on the wringing sleeve 124 in a helical pattern. In other embodiments, one or more volutes may be vertically oriented. Each volute 150, 152, 154, 156 may generally traverse the sleeve longitudinally with each volute 150, 152, 154, 156 arranged opposite its like volute around the circumference of the sleeve 124, as shown in FIG. 11. Because the first major volute 150 may be identical to the second major volute 152, only the first major volute 150 will be described in detail. The major volute 150 includes an outer surface 160 that may extend from the rim 138 at the lower opening 132 to an area 162 generally below the midpoint of the volute 150, where the outer surface 160 may end in a rounded bridge 164, as shown in FIG. 8. Referring to FIG. 11, the outer surface 160 represents a slightly raised surface on the outer surface 166 of the sleeve 124.

Referring to FIG. 7, the volute 150 also comprises a first fin 168 and a second fin 170 wherein the fins 168, 170 define a gap 174 therebetween along at least a portion of the volute 150. Referring to FIG. 11, the fins 168, 170 may project into the interior 176 of the sleeve 124. The fins 168, 170 may be curved such that they generally curve towards the gap 174 as they project into the interior 176 of the sleeve 124. In other embodiments, the fins may not be curved and may follow a linear or angled path towards the gap. Referring to FIG. 7, the fins 168, 170 may also follow the same helical path as the major volute 150. The outer surface 160 and the fins 168, 170 of the volute 150 may define a semi-enclosed area inside the wringer 120, wherein the semi-enclosed area is configured to receive a portion of the mop through the gap 174. In another embodiment, the volute may include only one fin to define a semi-enclosed area. In other embodiments, the volute may include other forms of engagement members to define a semi-enclosed area. Referring to FIG. 8, the fins 168, 170 may eventually join at some point 178 above the bridge 164 of the outer surface 160, thereby defining the end of the gap 174. Referring to FIG. 7, the fins 168, 170 may begin at the lower opening 132 of the sleeve 124 and quickly rise to the full fin height along curves 180, 182. The gap 174 may be a uniform width between the point 186 where the fins reach their full height and the point 178 where the fins join. The second major volute 152 also comprises an outer surface 190 and two fins 192, 194 defining a gap 196.

Referring to FIGS. 6 and 11, the minor volutes 154, 156 may follow a helical path similar to that of the major volutes 150, 152. Because the first minor volute 154 may be identical to the second minor volute 156, only the first minor volute 154 will be described in detail. Referring to FIG. 11, the minor volute 154 comprises a helicoid surface 200 that defines a rounded depression in the outer surface 166 of the wringing sleeve 124. Referring to FIGS. 6 and 7, the minor volute 154 may be of similar width as the major volute 150, but be of shorter length. The volute 154 may begin near the rim 138 of the lower opening 132 and extend up the sleeve 124 until a point 202 below the transition 128 to the wringer handle 122.

Figure 13:
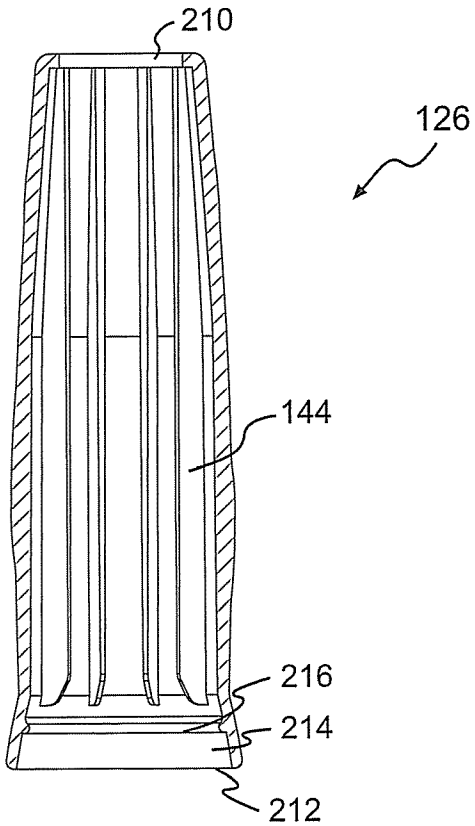
FIG. 13 is a cross-sectional view along line 13-13 of FIG. 12.
Figure 12:
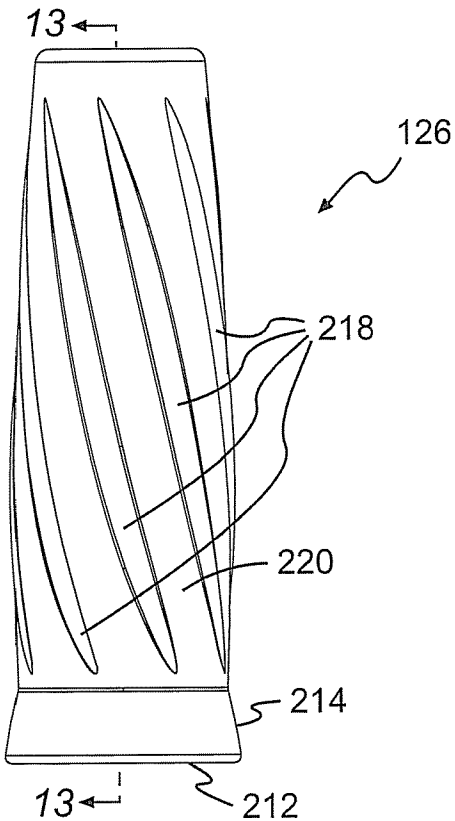
FIG. 12 is a side elevational view of the fixed grip of the cleaning implement of FIG. 1.

Referring to FIGS. 12 and 13, the fixed grip 126 of the cleaning implement 100 may be generally tubular with an upper opening 210 and a lower opening 212. The lower opening 212 may be defined by a flared female piece 214. Referring to FIG. 13, the female piece 214 may include an inner rim 216. The fixed grip 126 may include a plurality of helical canals 218 that traverse the grip 126 longitudinally. The helical canals 218 create a non-uniform surface 220 on the grip 126, which aid an operator in better gripping the fixed grip 126. Referring to FIG. 13, the fixed grip 126 may include a plurality of internal ribs 144 to help stabilize the fixed grip 126 on the shaft.

Referring to FIG. 14, the cleaning implement 100 is depicted in its fully retracted mopping position. When the cleaning implement 100 is in the mopping position, the wringer 120 may be in its uppermost position on the shaft 102. The female piece 214 of the fixed grip 126 may receive the male piece 134 of the wringer 120 and retain it therein via an interference fit between the lip 136 of the male piece 134 and the inner rim 216 of the female piece 214, as shown in FIG. 14. The interference fit between the fixed grip 126 and the wringer 120 thereby ensures that as the operator is mopping, the wringer 120 will not unintentionally descend from the mopping position. In order for an operator to release the wringer 120 from the fixed grip 126, the operator may pull the wringer 120 away from the fixed grip 126 with a predetermined force sufficient to overcome the interference fit between the female piece 214 and the male piece 134.

Figure 15:
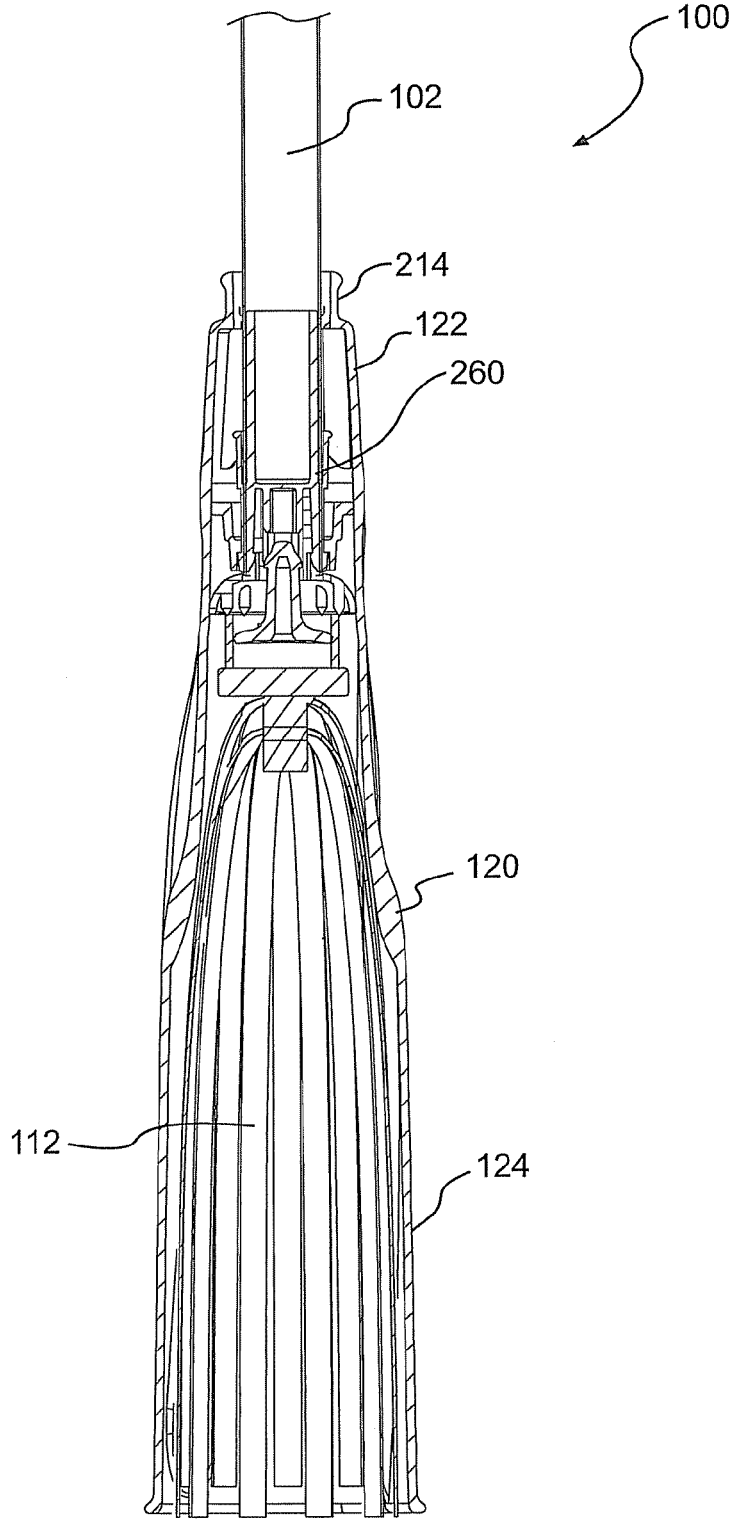
FIG. 15 is a partial cross-sectional view along line 14-14 of FIG. 2, wherein the wringing sleeve is in a wringing position.

Referring to FIG. 15, the cleaning implement 100 is shown in a wringing position in which the wringer 120 is in its lowermost position on the shaft 102. The wringing sleeve 124 may be of sufficient length such that the mop 112 is entirely drawn into the wringing sleeve 124 for compression therewithin by the time the sleeve 124 has advanced to this position.

Figure 16:
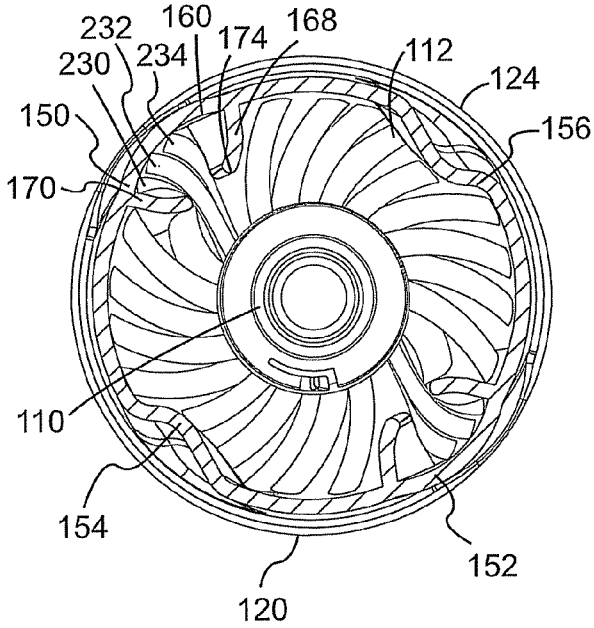
FIG. 16 is a cross-sectional view along line D-D of FIG. 8, wherein the wringer has been lowered over the mop.
Figure 17:
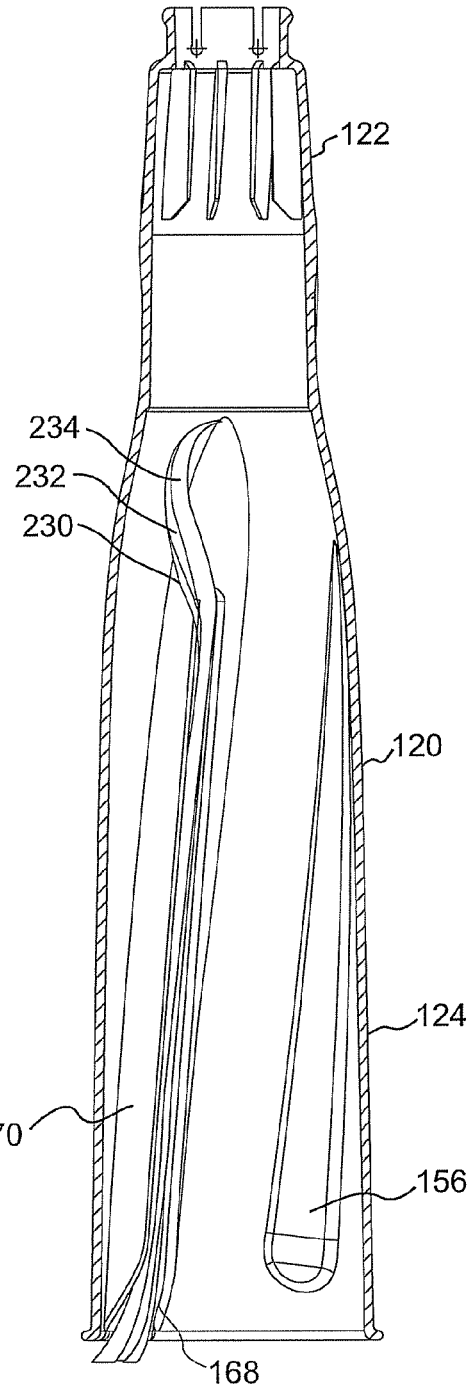
FIG. 17 is a cross section along line 7-7 of FIG. 6, wherein several mop strips are engaged by the major volute.

As the wringing sleeve 124 descends over the mop 112, one or more strips 230, 232, 234 of the mop 112 may be channeled into the major volute 150 by entering the gap 174 defined by the fins 168, 170, as shown in FIGS. 16 and 17. As the wringing sleeve 124 continues to descend over the mop 112, the strips 230, 232, 234 may be retained in the volute 150 as more of each strip 230, 232, 234 is threaded into the volute 150, until the sleeve 124 reaches its lowermost position, as shown in FIG. 18.

Figure 18:
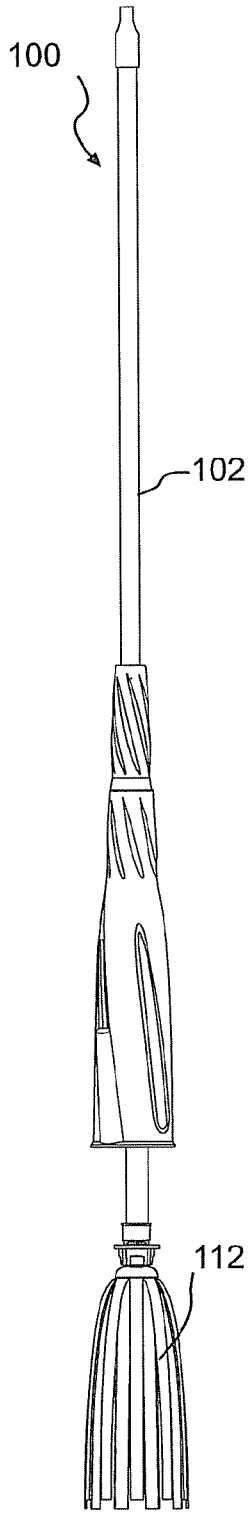
FIG. 18 is a side view elevational view of the cleaning implement of FIG. 1, wherein the wringer has been raised to the mopping position.

An operator may mop a surface to be mopped with the cleaning implement 100 in the mopping position, as shown in FIG. 18. As the operator mops, the absorbent material of the mop 112 may absorb liquid from the mopping surface. At some point, the mop 112 will absorb sufficient liquid that its ability to absorb more liquid may be diminished. At this point, the operator may wish to wring liquid from the mop 112, in order in order to revive the mops 112 capacity to absorb more liquid.

Figure 19:
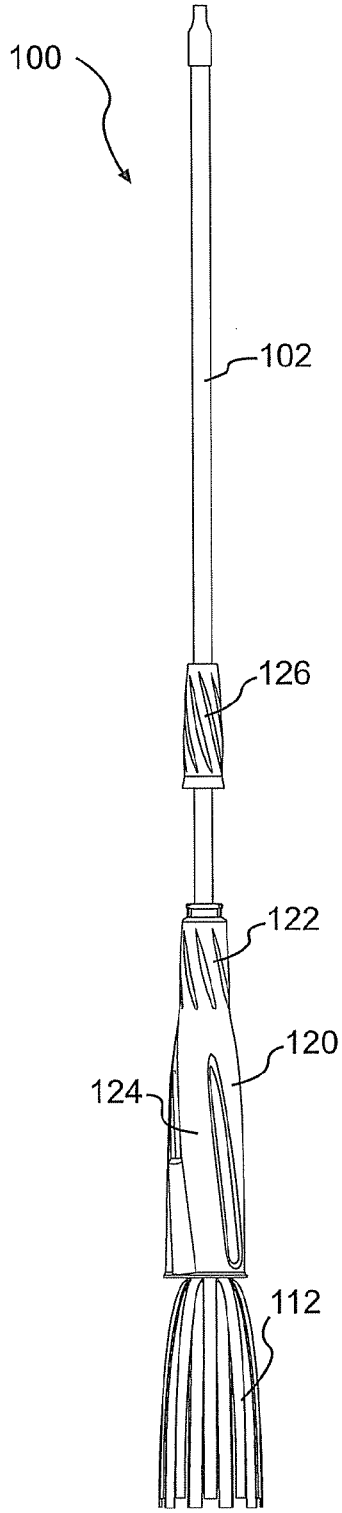
FIG. 19 is the same view as FIG. 18, except the wringer has been lowered to an intermediate position.

Referring to FIG. 19, the first step in the wringing operation may be to disengage the wringer 120 from the fixed grip 126 by pulling the wringer down from the fixed grip 126, thereby overcoming the interference fit between the wringer 120 and the grip 126. During the wringing operation, the operator may grip the cleaning implement 100 with one hand at the fixed grip 126 while using the other hand to grip the wringer at the wringer handle 122. In this way, the operator will be able to manipulate the wringer 120 relative to the remainder of the cleaning implement 100.

Figure 20:
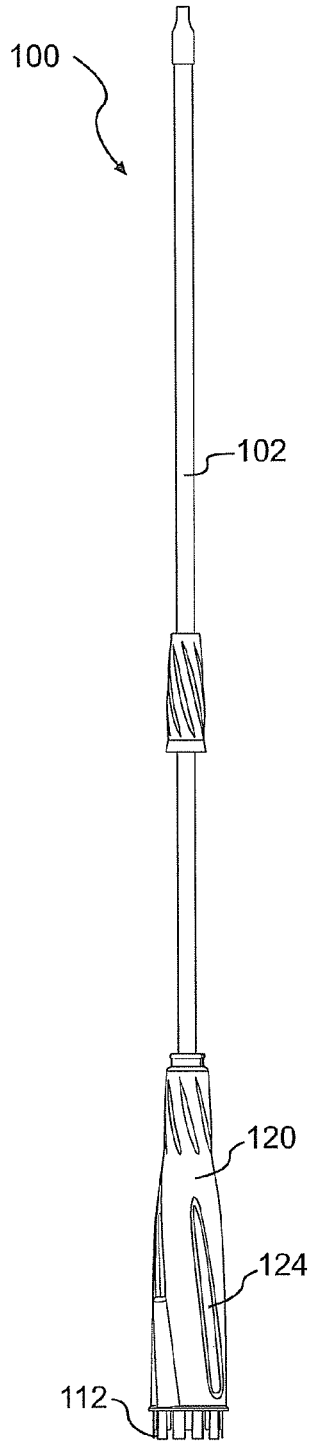
FIG. 20 is the same view as FIG. 18, except the wringer has been lowered over the mop.

The operator may continue to slide the wringer 120 down until it descends over the mop 112, as shown in FIG. 20. As the mop 112 is drawn into the wringer 120, the mop 112 is compressed due to the inside volume of the wringing sleeve 124 being smaller than the volume occupied by the mop 112 while in the mopping position, as show in FIGS. 14 and 15. The compression of the mop 112 may cause some of the absorbed liquid to be expelled from the mop 112.

As shown in FIGS. 16 and 17, a group of strips 230, 232, 234 may enter the major volute 150 as the wringing sleeve 124 is lowered over the mop 112. Because of the helical pattern of the major and minor volutes 150, 152, 154, 156, the mop 112 may also be slightly twisted as the mop 112 enters the sleeve 124, as shown in FIG. 16. The mop strips 230, 232, 234 may be fixed to the mop assembly 110, and the mop assembly 110 may be fixed to the shaft 120, thereby prohibiting rotation of the strips 230, 232, 234 relative the assembly 110 and rotation of the assembly 110 relative the shaft 102. As the sleeve 124 descends over the mop 112, the mop strips 230, 232, 234 remain fixed at the assembly 110 while the helical volutes 150, 152, 154, 156 may direct the lower portions of the strips 230, 232, 234 to follow a generally helical path, thereby resulting in slight twisting of the mop 112. This slight twisting of the mop 112 may wring further liquid from the mop 112.

Figure 21:
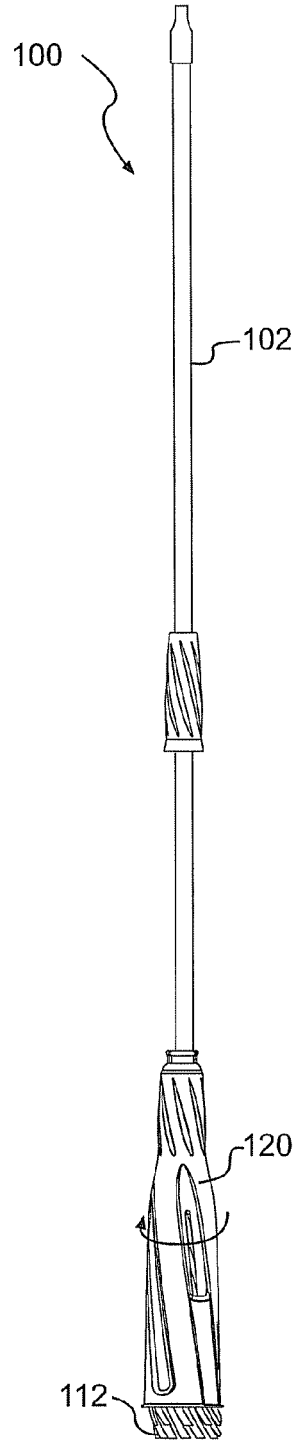
FIG. 21 is the same view as FIG. 18, except the wringer has been rotated, thereby twisting the mop.
Figure 22:
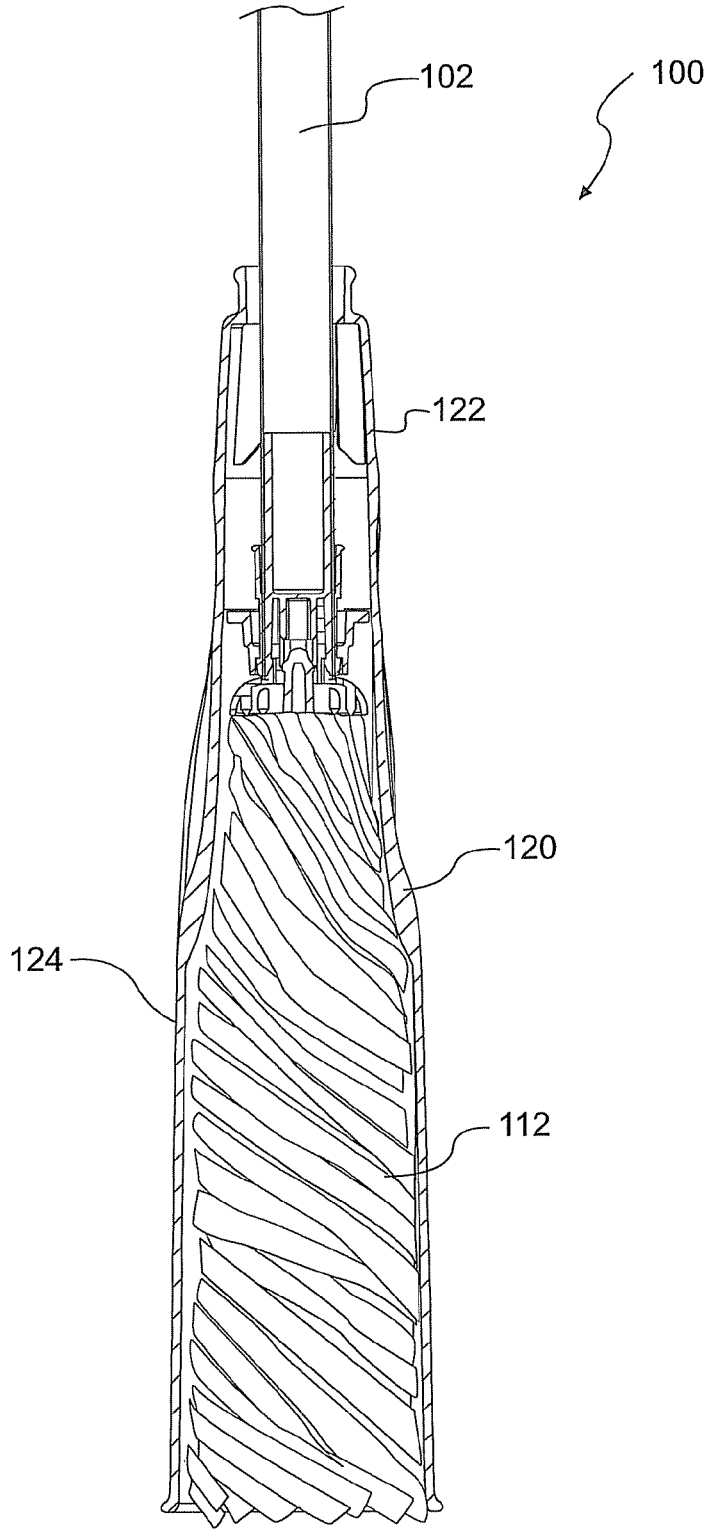
FIG. 22 is a partial cross-sectional view along line 14-14 of FIG. 2, wherein the operator has twisted the wringer while the wringer was in the wringing position.

Referring to FIG. 21, the operator may rotate the wringer 120 relative the shaft 102 to expel even further liquid from the mop 112 after the wringing sleeve 124 is lowered over the mop 112. The operator may rotate the mop 112 in the same direction the volutes 150, 152, 154, 156 traverse the wringer 120 as the volutes 150, 152, 154, 156 extend up the wringing sleeve 124. Because some strips of the mop 112 are retained within the major volutes 150, 152, the mop 112 is engaged with the inside surface of the wringing sleeve 124. This prevents the wringing sleeve 124 from simply rotating around the mop 112. Instead, because a portion of the mop 112 is engaged with the wringer 120, the mop 112 is twisted by generally following the rotation of the wringer 120, as shown in FIG. 22. The wringer 120 thereby wrings water from the mop 112 by twisting the mop 112. The operator may achieve a greater degree of twist in the mop 112 by manually twisting the wringer 120, as shown in FIG. 22, than by simply lowering the wringer over the mop. The operator may control how much water is expelled from the mop 112 by selecting how much the wringer 120 is rotated relative to the shaft 102. For example, the operator may rotate the wringer by less than one turn. Alternatively, the operator may rotate the wringer one, two, three, four, five, or six full 360 degree revolutions, or to any point in between.

Referring to FIG. 8, the gap 174 of the volute 150 defines a break in the wringer 120 above the bridge 164 of the outer surface 160. Because the outside surface 160 of the major volute 150 extends only partway up the volute 150, the fins 168, 170 and fins are fully exposed on a portion of the wringer 120. Because the volute 150 is unsupported by the outer surface 160 of the volute 150 along a portion of the gap 174, the wringer 120 enjoys increased flexibility. This increased flexibility allows the wringer 120 to more easily eject the mop 112 after the wringing operation. The gap 174 in the volute 150 may better enable water to escape from the wringer 120 during the wringing operation.

Figure 23:
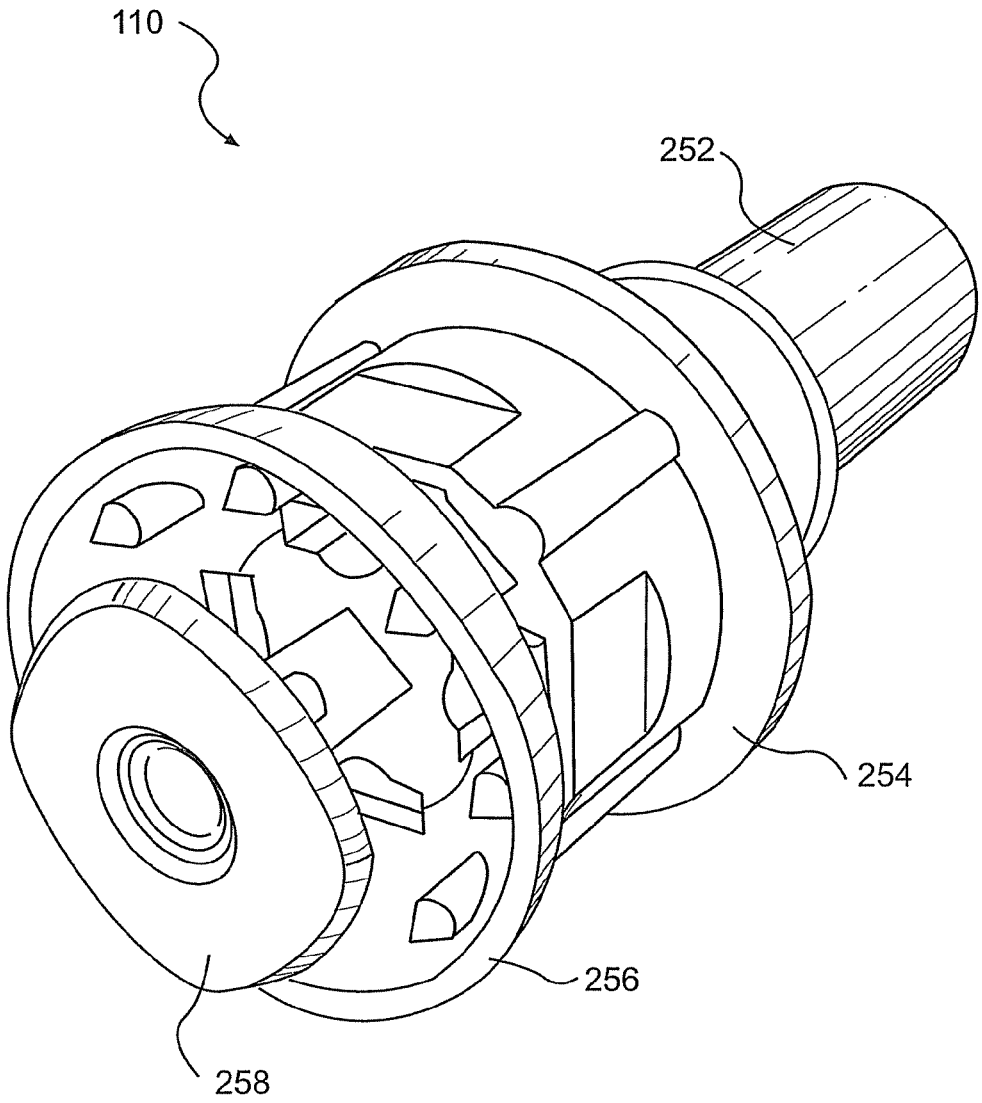
FIG. 23 is a perspective view of the mop assembly of the cleaning implement of FIG. 1.
Figure 24:
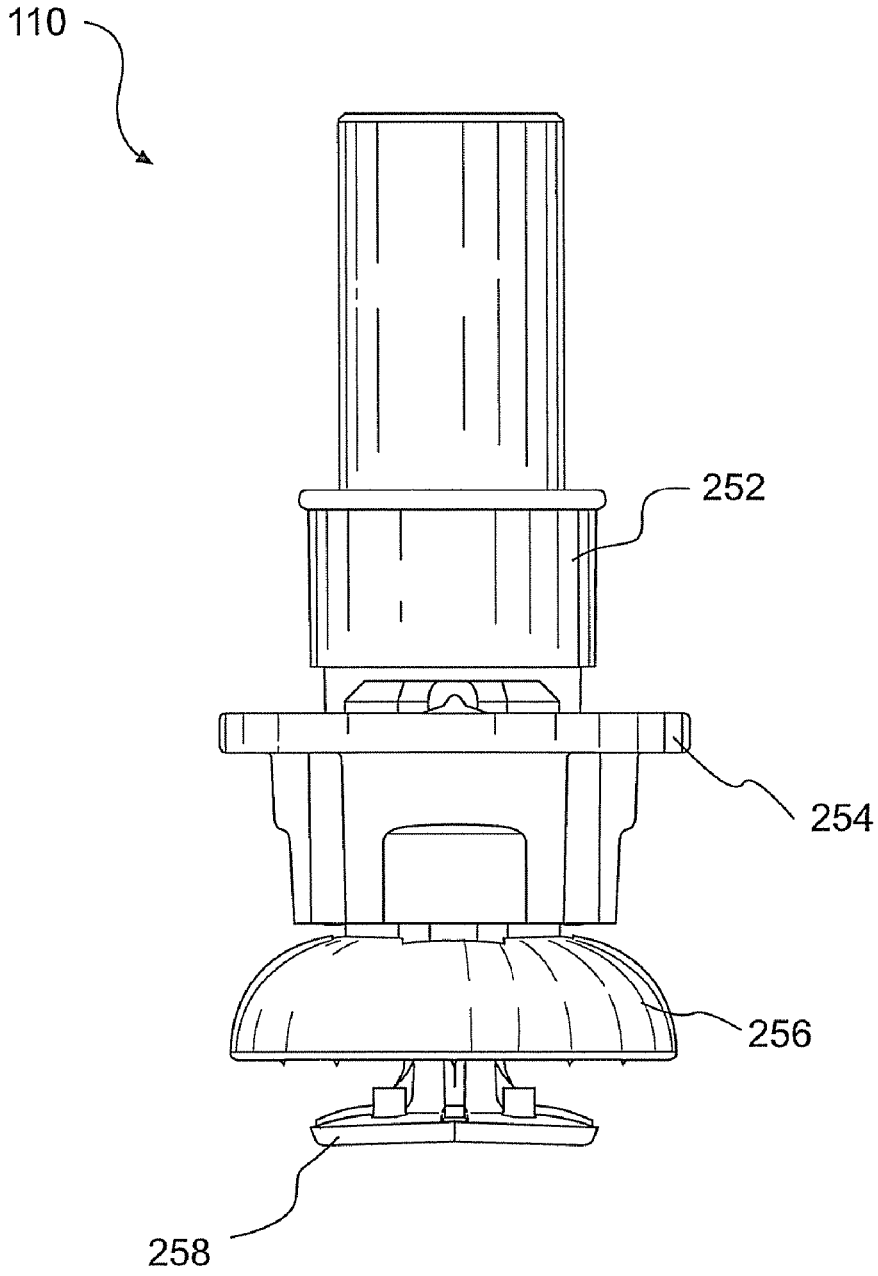
FIG. 24 is a side elevational view of the mop assembly of FIG. 23.
Figure 25:
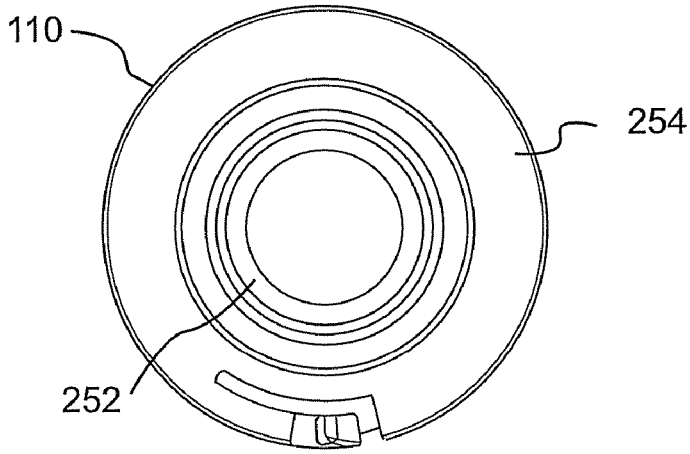
FIG. 25 is a top plan view of the mop assembly of FIG. 23.
Figure 26:
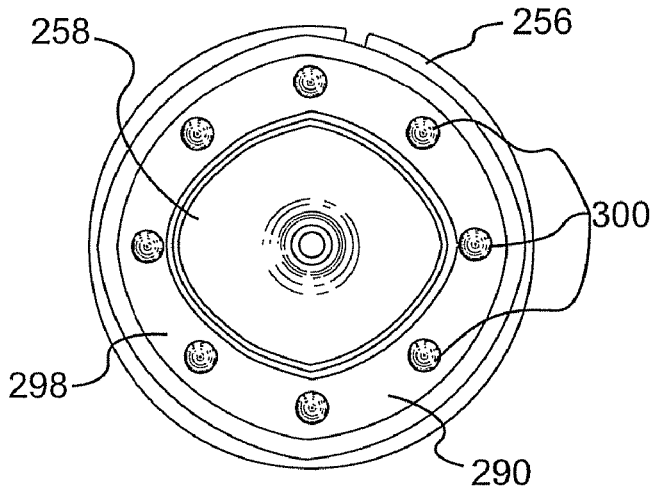
FIG. 26 is a bottom plan view of the mop assembly of FIG. 23.
Figure 27:
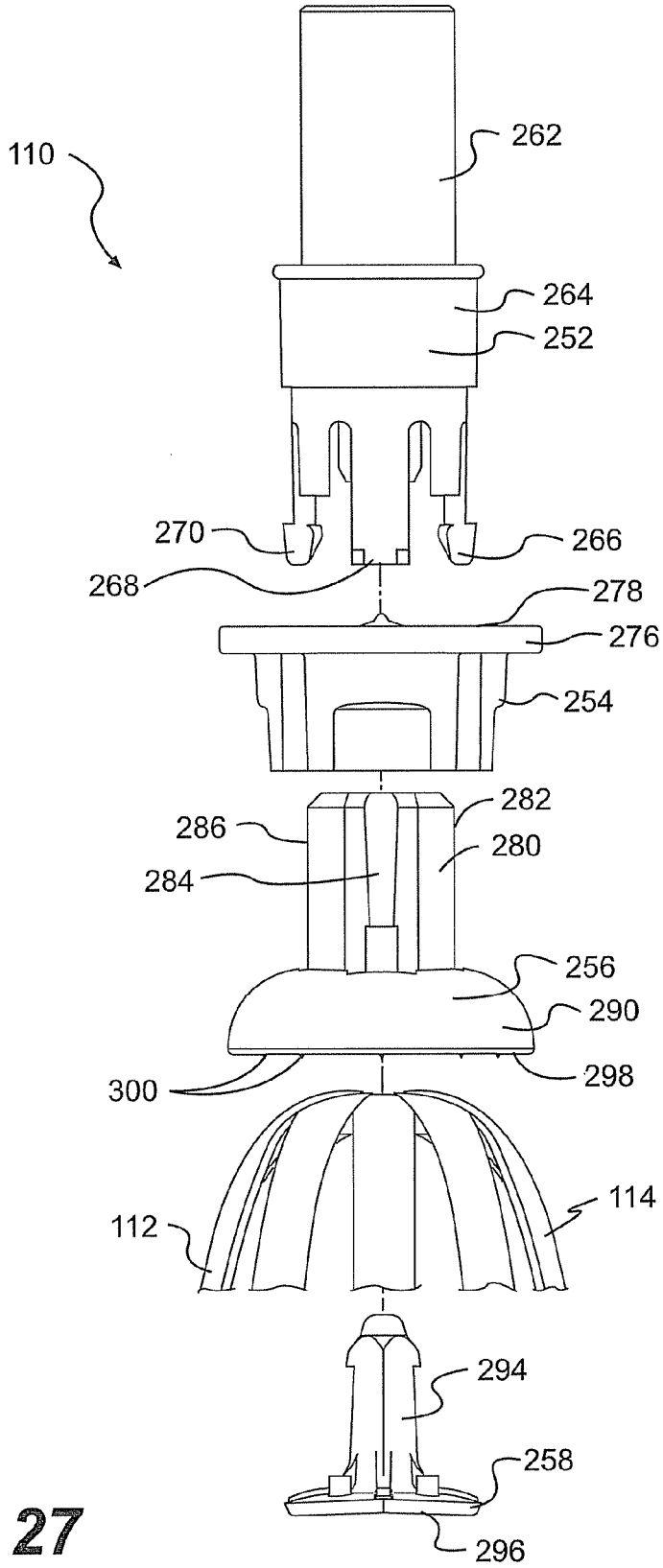
FIG. 27 is a side exploded view of the mop assembly of FIG. 23 wherein the mop strips are also shown.

Referring to FIG. 23, the mop assembly 110 is depicted without the mop strips. The mop assembly 110 includes a shaft plug 252, a collar 254, a socket piece 256, and a bottom plug 258, as show in FIG. 24. The shaft plug 252 may be configured to be inserted into the lower opening 260 of the shaft 102 and be retained therein by, for example, a friction fit, as show in FIG. 15. Referring to FIG. 27, the shaft plug 252 has a plug piece 262 and bottom piece 264, wherein the bottom piece 264 includes post elements 266, 268, 270 for engaging the socket piece 256. The collar 254 may include a rim 276 that defines a hole 278 that passes through the collar 254. The hole 278 defined by the collar 254 may be configured to slide over the upper piece 280 of the socket piece 256. The upper piece 280 of the socket piece 256 may also include channels 282, 284, 286 to receive the post elements 266, 268, 270 of the shaft plug 252, and retain them therein via an interference fit. The socket piece 256 may further comprise a rounded mop cover 290. The socket piece 256 may also define a socket configured to receive a post 294 of the bottom plug 258. The bottom plug 258 may include a flange 296. Extending up from the flange 296 is the post 294, which is configured to be inserted into the socket of the socket piece 256 and retained therein by an interference fit. The bottom plug 258 and the socket piece 256 may trap the mop strips 114 of the mop 112 therebetween. The inside surface 298 of the mop cover 290 may include spikes 300 to help hold the mop strips 114 between the mop cover 290 of the socket piece 256 and the flange 296 of the bottom plug 258.

Figure 28:
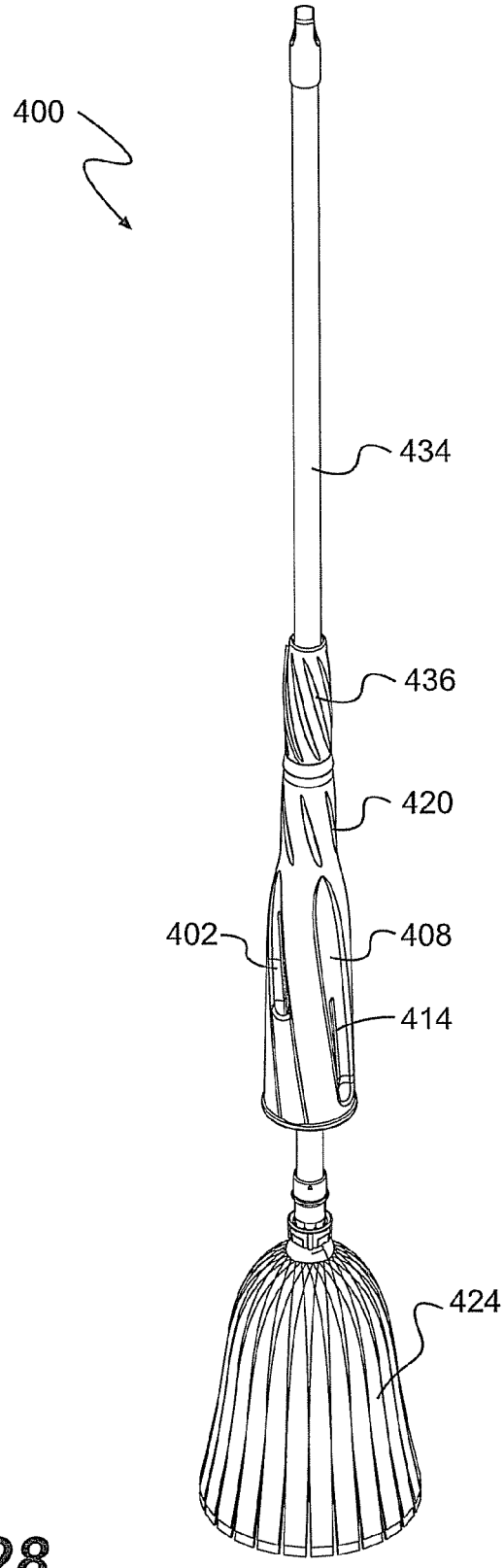
FIG. 28 is a perspective view of another embodiment of the cleaning implement.
Figure 29:
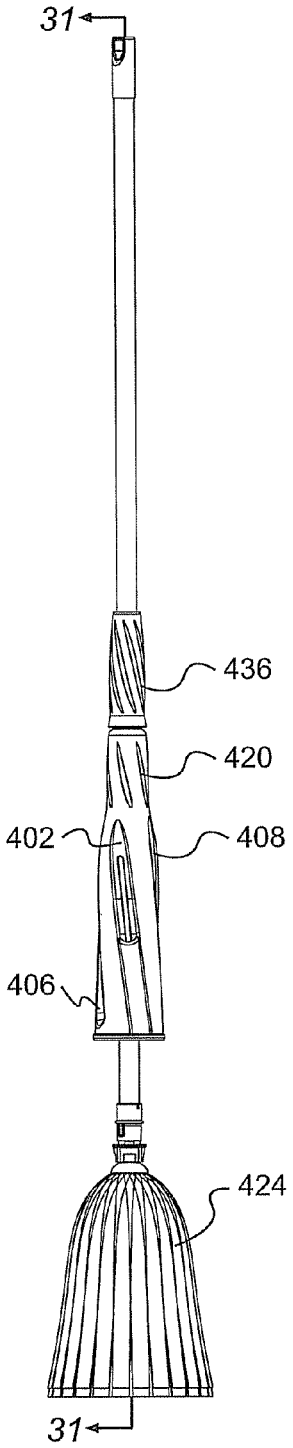
FIG. 29 is a front elevational view of the cleaning implement of FIG. 28.
Figure 30:
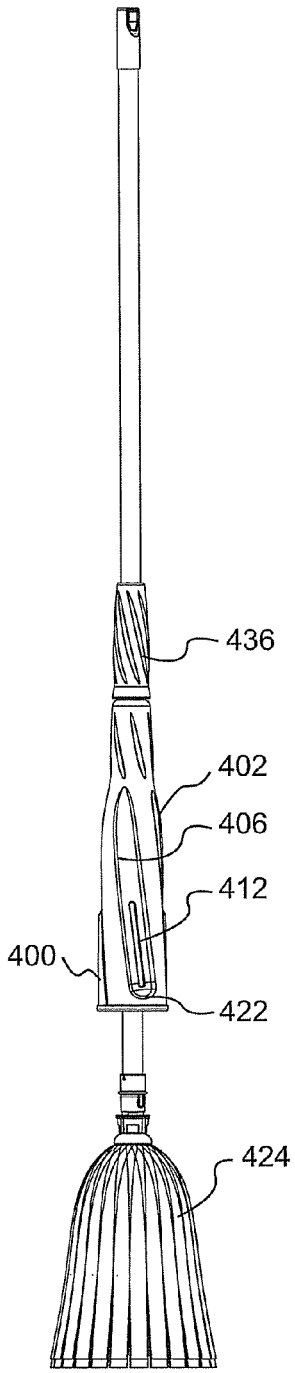
FIG. 30 is a side elevational view of the cleaning implement of FIG. 28.

Referring to FIG. 28, there is shown another embodiment. The cleaning implement 400 may include two major volutes 402, 404 and two minor volutes 406, 408, as shown in FIGS. 29 and 30. The first and second minor volutes 406, 408 may include respective slots 412, 414 that pass through the wringer 420. The first and second minor volutes may be similarly constructed. Accordingly, only the first minor volute will be described in detail. Referring to FIG. 30, the slot 412 may be centrally located within the first minor volute 406. The slot 412 may begin near the bottom 422 of the volute 406 and may extend up approximately half of the length of the volute 406. The slots 412, 414 in the minor volutes 406, 408 engender increased flexibility in the wringer 420, thereby making it easier for the wringer 420 to eject the mop 424 after the wringing operation. The slots 412, 414 further enable the escape of water from the mop 424 and the wringer 420 during the wringing operation.

Figure 31:
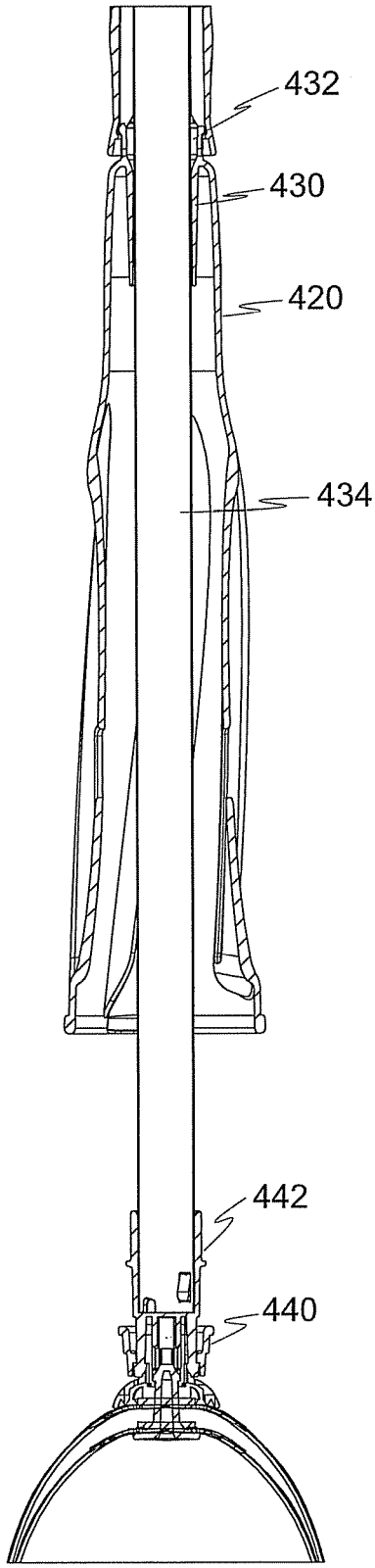
FIG. 31 is a fragmentary cross section along line 31-31 of FIG. 29.

Referring to FIG. 31, the wringer 420 may include an annular internal collar 430 disposed proximate the upper opening 432. The internal collar 430 provides a continuous surface that may engage the shaft 434 of the cleaning implement 400. The collar 430 may help stabilize the wringer 420 as it moves up and down the shaft 434.

Figure 32:
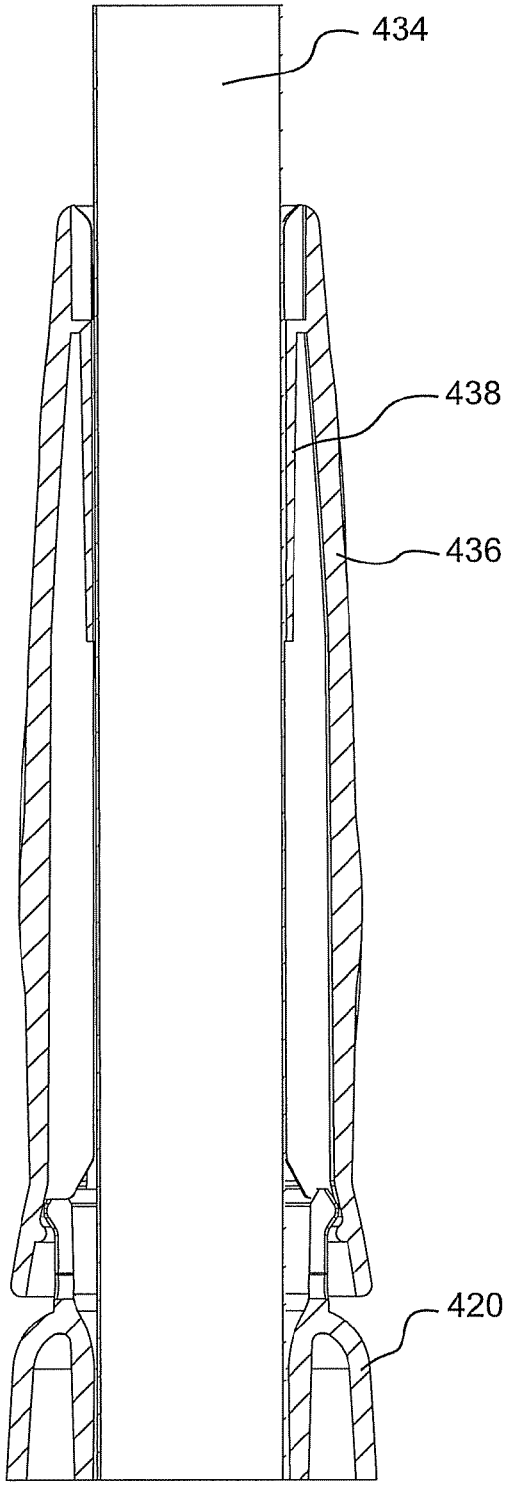
FIG. 32 is a fragmentary cross section along line 31-31 of FIG. 29.

Referring to FIG. 32, the fixed grip 436 may include an annular internal collar 438. The annular internal collar 438 may provide a continuous surface to help stabilize the fixed grip 436 on shaft 434.

Figure 33:
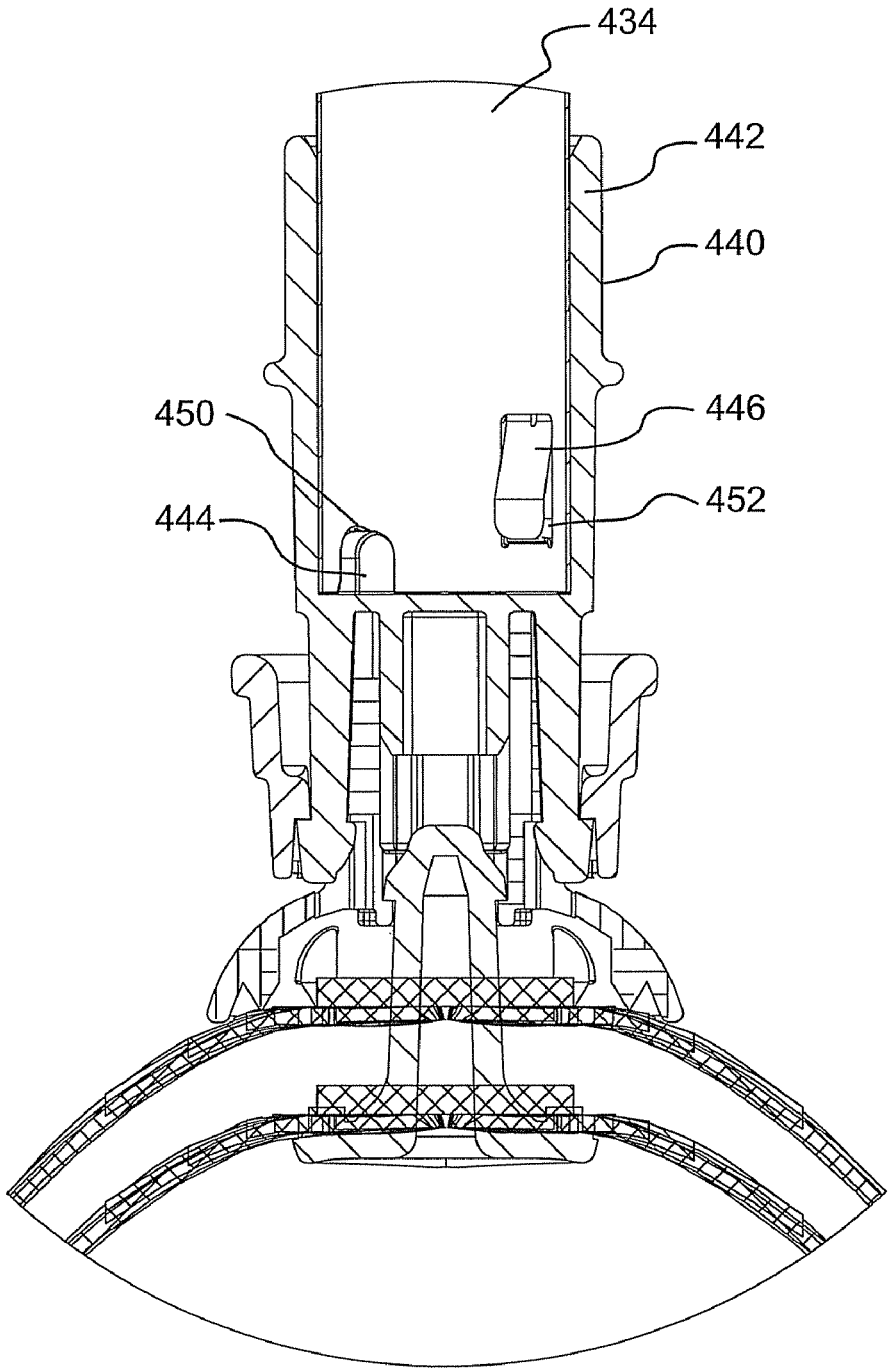
FIG. 33 is a fragmentary cross section along line 31-31 of FIG. 29.

Referring to FIG. 31 the mop assembly 440 may include an upper collar 442 that receives the shaft 434. Referring to FIG. 33, the upper collar 442 may include a first internal tab 444 and a second internal tab 446 that correspond to a first slot 450 and a second slot 452, respectively on the shaft 434. The first and second slots 450, 452 may receive the first and second tabs 444, 446, respectively, in order to help secure the mop assembly 440 to the shaft 434.

All references, including publications, patent applications, and patents, cited herein are hereby incorporated by reference to the same extent as if each reference were individually and specifically indicated to be incorporated by reference and were set forth in its entirety herein.

The use of the terms "a" and "an" and "the" and similar referents in the context of describing the invention (especially in the context of the following claims) are to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventor(s) for carrying out the invention. Variations of those preferred embodiments may become apparent to those of ordinary skill in the art upon reading the foregoing description. The inventor(s) expect skilled artisans to employ such variations as appropriate, and the inventor(s) intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

The invention claimed is:

1. A cleaning implement comprising;

a shaft including an operator end and a mopping end;

a mop assembly including a mop;

a wringer defining a cavity configured to receive the mop, the wringer attached to the shaft wherein the wringer is moveable axially and rotatably relative to the shaft, the wringer including, at least one major volute that extends into an interior area of the wringer, the major volute includes a slot that passes through the wringer, the slot being elongate and extending along at least a portion of the at least one major volute.

2. The cleaning implement of claim 1, wherein the wringer further comprises a minor volute.

3. The cleaning implement of claim 1, wherein the major volute includes a first fin and a second fin that help define a semi-enclosed area inside the wringer, the semi-enclosed area configured to receive a portion of the mop through a gap defined between the first and second fins.

4. The cleaning implement of claim 3, wherein the slot in the major volute is defined by the gap between the first and second fins.

5. The cleaning implement of claim 2, wherein the minor volute includes a slot that is shorter in length than the slot of the major volute.

6. The cleaning implement of claim 1, wherein the major volute follows a helical path.

7. The cleaning implement of claim 1, the mop assembly further comprising a shaft connector piece for connecting the assembly to the shaft and a socket piece configured to receive a bottom plug, wherein the mop is between the bottom plug and the socket piece.

8. The cleaning implement of claim 7, the mop assembly further comprising a collar, the socket piece including channels to receive post elements of the shaft connector piece, wherein the collar may slidably cover the post elements of the shaft connector piece.

9. A cleaning implement comprising;

a shaft including an operator end and a mopping end;

a mop assembly including a mop;

a wringer defining a cavity configured to receive the mop, the wringer attached to the shaft wherein the wringer is moveable axially and rotatably relative to the shaft, the wringer including a first fin and a second fin disposed along a helical path on an inside surface of the wringer, the first fin and the second fin projecting from the inside surface into an interior of the wringer, wherein the fins define a gap therebetween to receive a portion of the mop.

10. The cleaning implement of claim 9, wherein the fins are disposed at an angle with respect to each other such that the distance between the fins is narrowest at the gap.

11. The cleaning implement of claim 9, wherein the wringer includes a slot that communicates with the gap between the first and second fins.

12. The cleaning implement of claim 9, wherein the first and second fins correspond to a volute.

13. The cleaning implement of claim 9, wherein the first and second fins are curved.

14. The cleaning implement of claim 9, wherein the wringer includes a plurality of fins disposed in pairs on the inside surface of the wringer.

15. The cleaning implement of claim 9, the mop assembly further comprising a shaft connector piece for connecting the assembly to the shaft and a socket piece configured to receive a bottom plug, wherein the mop is between the bottom plug and the socket piece.

16. The cleaning implement of claim 15, the mop assembly further comprising a collar, the socket piece including channels to receive post elements of the shaft connector piece, wherein the collar may slidably cover the post elements of the shaft connector piece.

17. A cleaning implement comprising;

a shaft including an operator end and a mopping end;

a mop assembly including a mop;

a wringer defining a cavity configured to receive the mop, the wringer attached to the shaft wherein the wringer is moveable axially and rotatably relative to the shaft, the wringer including a first fin and a second fin disposed on an inside surface of the wringer, the first fin and the second fin projecting from the inside surface into an interior of the wringer, wherein the fins define a gap therebetween to receive a portion of the mop, and wherein the fins are curved.

18. The cleaning implement of claim 17, wherein the fins are disposed at an angle with respect to each other such that the distance between the fins is narrowest at the gap.

19. The cleaning implement of claim 17, wherein the wringer includes a slot that communicates with the gap between the first and second fins.

20. The cleaning implement of claim 17, wherein the first and second fins correspond to a volute.

21. The cleaning implement of claim 17, wherein the first and second fins curve into the interior of the wringing sleeve towards the gap.

22. The cleaning implement of claim 17, wherein the wringer includes a plurality of fins disposed in pairs on the inside surface of the wringer.

23. The cleaning implement of claim 17, the mop assembly further comprising a shaft connector piece for connecting the assembly to the shaft and a socket piece configured to receive a bottom plug, wherein the mop is between the bottom plug and the socket piece.

24. The cleaning implement of claim 23, the mop assembly further comprising a collar, the socket piece including channels to receive post elements of the shaft connector piece, wherein the collar may slidably cover the post elements of the shaft connector piece.

* * * * *